United States Patent [19]

Hamsher, Jr. et al.

[11] Patent Number: 4,690,647

[45] Date of Patent: Sep. 1, 1987

[54] ELECTRICAL CONTACT FOR RECEIVING TWO CONDUCTORS

[75] Inventors: Wilbur A. Hamsher, Jr., New Cumberland; William B. Long, Camp Hill, both of Pa.

[73] Assignee: AMP Incorporated, Harrisburg, Pa.

[21] Appl. No.: 882,048

[22] Filed: Jul. 3, 1986

[51] Int. Cl.[4] ..... H01R 4/66

[52] U.S. Cl. ..... 439/92; 29/861

[58] Field of Search ..... 339/14 R, 276 SF, 276 R, 339/276 T, 276 S, 95 R, 277 R; 29/861, 874

[56] References Cited

U.S. PATENT DOCUMENTS 4,491,381 1/1985 Hamsher et al. ..... 339/14 R X 4,579,404 4/1986 Lockard ..... 339/14 R 4,602,830 7/1986 Lockard ..... 339/14 R 4,602,831 7/1986 Lockard ..... 339/14 R 4,649,636 3/1987 Arbogast, Jr. et al. ..... 29/861

4,655,515 4/1987 Hamsher, Jr. et al. ..... 339/14 R

*Primary Examiner*—Eugene F. Desmond

*Attorney, Agent, or Firm*—Anton P. Ness

[57] ABSTRACT

A contact terminal has a termination section at one end thereof including a spaced pair of axially-extending slots within each of which a respective one of a pair of conductor wires is held in interference fit for weld termination such as by laser welding. The terminal can be a ground terminal for the pair of ground conductors of a tri-lead cable.

3 Claims, 12 Drawing Figures

Fig. 4C
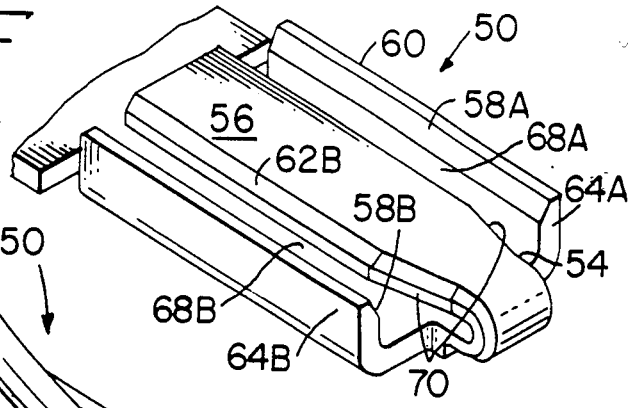
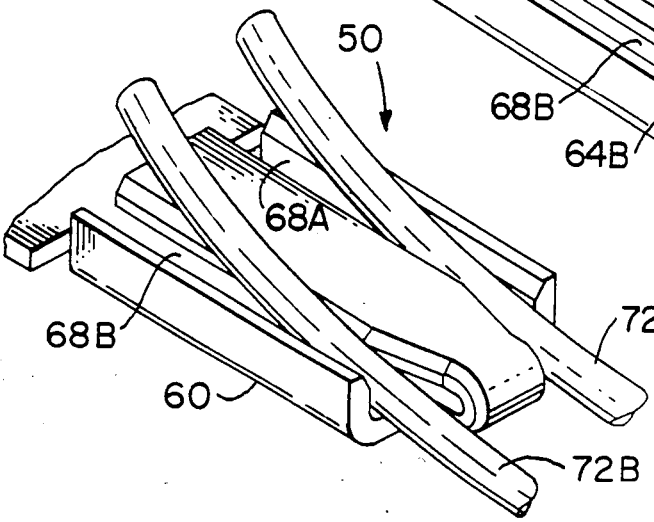
Fig. 5A
Fig. 5B
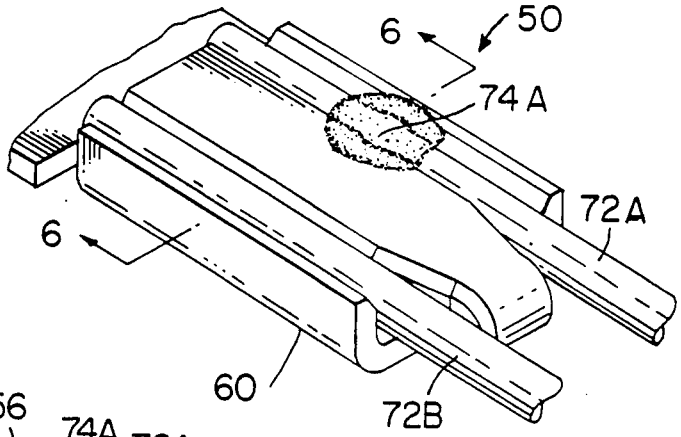
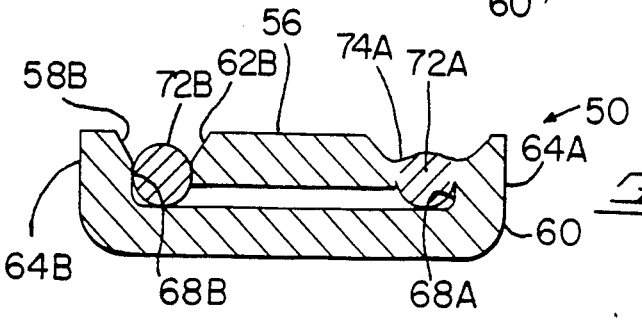
Fig. 6

ELECTRICAL CONTACT FOR RECEIVING TWO CONDUCTORS

FIELD OF THE INVENTION

This relates to the field of electrical connectors and more particularly to contact terminals for conductor termination.

BACKGROUND OF THE INVENTION

Electrical contact terminals are known which are used to terminate a pair of conductors in a single slot by welding, particularly by laser welding. Such contact terminals are known from U.S. Pat. No. 4,579,404 for use in a single-row electrical connector for terminating the pairs of ground conductors in tri-lead high speed signal transmission cables. A similar but double row connector is known from U.S. patent application Ser. No. 754,785 filed July 12, 1985 and assigned to the assignee hereof. Such terminals require the pairs of ground conductors to be brought together side-by-side near the top of the slot and in interference fit therein for termination remote from the respective signal conductors of the cables. The signal conductors are separately but similarly terminated to respective signal terminals insulated from the ground terminals by the dielectric carrier to which the terminals are secured, and the entire conductor-terminated subassembly is then overmolded forming the connector. Contact sections of the terminals are disposed at the forward end of the connector, ready for electrical engagement with corresponding terminal means of a mating electrical connection means.

When the side-by-side conductors are laser welded, the area of the weld joint of course is wider than if a single conductor were being welded in a correspondingly narrower slot. In both cases the weld joint must join to the sidewalls of the slot whose top surfaces are preferably approximately coplanar with the top portions of the conductor or conductors for optimizing the laser weld termination. However, a typical conductor diameter is about 0.010 inches and the corresponding weld joint for the side-by-side conductors is about 0.040 to 0.045 inches in diameter. A smaller weld joint for only one such conductor requires less energy of the laser beam during welding, and a lower energy incurs less risk of damaging the very small conductor wire.

From U.S. Pat. Nos. 4,602,831 (for a single-row connector) and 4,655,515 (for a double-row connector), both assigned to the assignee hereof, it is known to place individual signal terminals along one side of a dielectric contact carrier, and a single ground plane on the other side of the carrier. In U.S. Pat. No. 4,602,831 all ground conductors of the single row of tri-lead cables (or a tri-lead flat cable) are terminated to the ground plane, singly in respective single width slots by welding such as laser welding. In U.S. Pat. No. 4,655,515 ) each row of cables (or each flat cable) has a contact carrier associated with it having signal terminals on one side and a single ground plane on the other, with each slot of the ground plane receiving a pair of side-by-side ground conductors therein for laser weld termination. Either ground plane is formed by first stamping the plurality of slots in a metal blank near one side edge of the blank, then folding over a portion of the blank along that side edge so that the slots now extend out to the newly formed edge to receive the conductor or pair of conductors. But with either ground plane all grounds of a row of cables (or of the flat cable) are terminated only on the same side of the carrier, and each row of cables or flat cable requires its own contact carrier. Thus, either type of ground plane delimits or complicates the programmability of a double-row connector, and cannot be used in the double-row connector of aforementioned Ser. No. 754,785.

It is desirable to provide a connector for tri-lead cable for high integrity high speed signal transmission using individual ground contact terminals which each receive two small diameter ground conductors in individual slots for separate spaced weld termination without substantially distorting the conductors.

It is also desirable to provide a contact for two conductor wires which includes a separate slot for each conductor, each for receiving a respective one of the conductors for individual weld termination, to eliminate both the necessity for gathering the two conductors to a side-by-side arrangement to be disposed along a single slot, and the necessity for carefully wiping the pair of wires together when being force-fit into a single slot in a manner whereby the conductors are held in a true side-by-side arrangement after being wiped into the slot.

It is further desirable to provide separate slots in a single contact for respective ones of a pair of conductors to reduce the necessary width of the weld joint when the welding is laser welding, to provide an assured laser weld joint without damaging the conductor wire.

SUMMARY OF THE INVENTION

A stamped and formed contact terminal with a contact section proximate one end thereof, has a spaced pair of parallel slots extending inwardly from the other end thereof to receive respective conductors thereinto to be held in interference fit therein for weld termination such as by laser welding. Each slot has at least at one axial location therealong a width slightly less than the diameter of the conductor and holds its conductor so that the top most portion of its conductor is approximately coplanar with the top of at least one side of the slot.

It is an objective of the present invention to provide a terminal to terminate separately two small diameter conductors at one terminal location within a multi-terminal connector, such as the pair of ground conductors of a tri-lead cable, which terminal can be located on either side of a contact carrier independently of other signal and ground terminal means.

It is another objective of the present invention to provide a terminal to simplify the wire handling procedure prior to weld termination and it is still a further objective to enable assured laser weld termination of ground conductors.

BRIEF DESCRIPTION OF THE DRAWINGS

FIGS. 4A to 4C illustrate the forming of the termination section of another embodiment of the dual slot terminal of the invention.

FIGS. 5A and 5B illustrate the placement of conductors in the slots of the terminal of FIGS. 4A to 4C and weld termination of one of them.

FIG. 6 is a cross-sectional view taken along lines 6—6 of FIG. 5B and showing the laser weld termination joint of one of the conductors.

DETAILED DESCRIPTION OF THE PREFERRED EMBODIMENT

Figure 1:
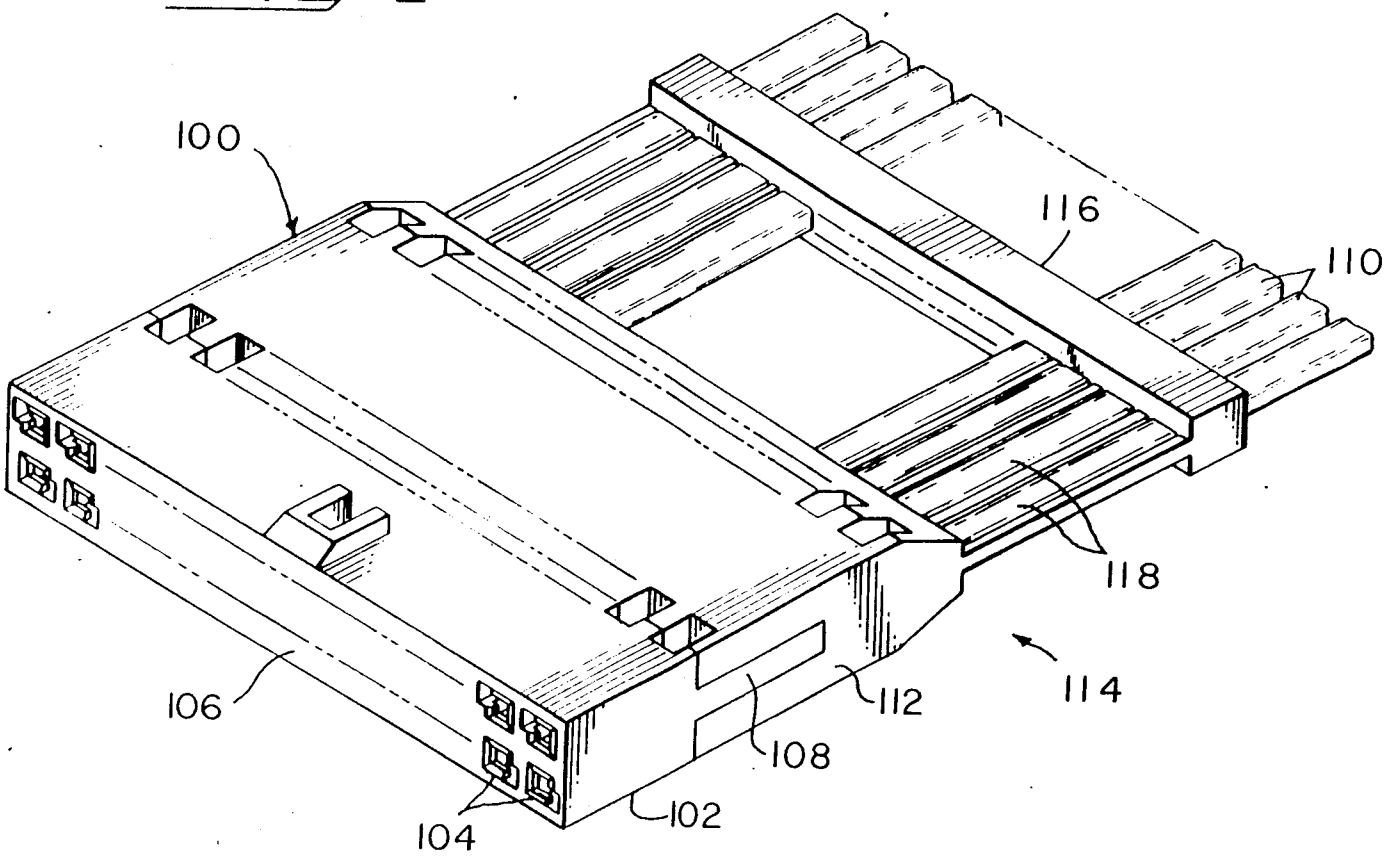
FIG. 1 is a double-row connector for signal transmission cable in which the present invention may be used.

In FIG. 1 is shown an electrical connector such as that of U.S. Ser. No. 754,785. Connector 100 comprises a terminal assembly 102 having a plurality of terminals disposed in passageways 104 extending rearwardly from the mating face 106 of the connector. Rearward sections of the terminals (not shown) extend along a contact-carrying portion 108 of the terminal assembly and are terminated to conductors of cables 110. A dielectric covering 112 is overmolded over the terminal assembly sealing the terminations and extending along cables 110 securing the cables to the connector to form a cable harness 114 and provide nondistorting strain relief. Also seen is a transverse bar 116 spaced rearwardly from covering 112 and joined to it by axial webs 118, bar 116 also being molded over the cables integrally with covering 112 and providing secondary nondistorting strain relief for the cables and also spacing and supporting them.

Figure 2:
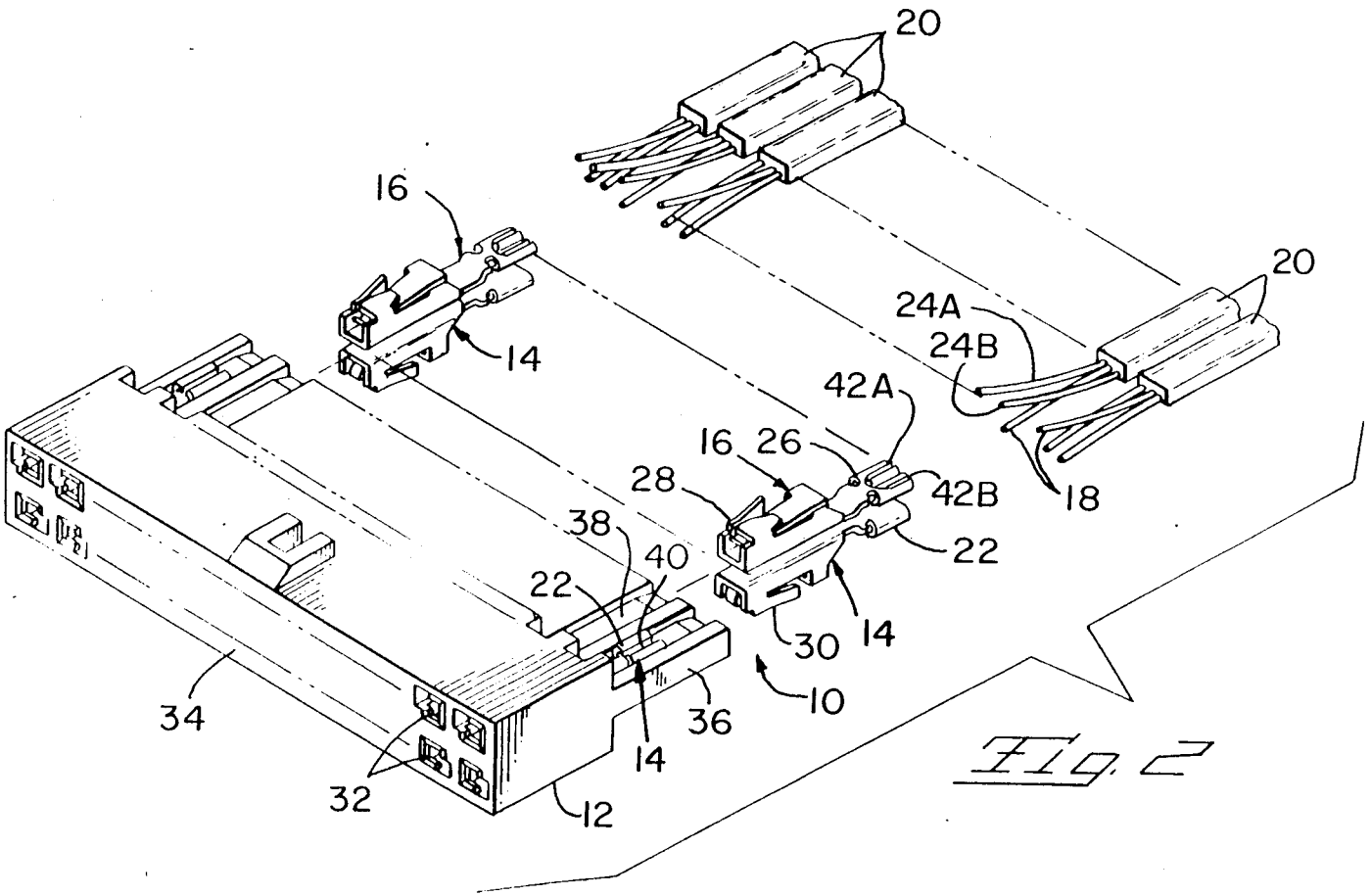
FIG. 2 is an exploded view of a terminal assembly usable with the electrical connector of FIG. 1, using the dual slot terminal of the present invention.

FIG. 2 shows a terminal assembly 10 usable in such a connector, which assembly comprises a premolded forward housing member 12, signal terminals 14 and ground terminals 16. Signal conductors 18 of cables 20 are stripped to be terminated to termination sections 22 of signal terminals 14, and pairs of ground conductors 24A,24B of cables 20 and stripped to be terminated to termination sections 26 of ground terminals 16. Contact sections 28 of ground terminals 16 are identical to contact sections 30 of signal terminals 14 and will be disposed along and secured within passageways 32 of housing 12 which extend from housing mating face 34 to contact-carrying portion 36. Termination sections 22,26 of signal and ground terminals 14,16 extend along contact-carrying portion 36, preferably in shallow recesses 38 thereof. Terminal assembly 10 is assembled by securing contact sections 28,30 of terminals 14,16 within passageways 32 of housing 12, then terminating conductors 18,24A,24B to appropriate ones of terminals 14,16, and thereafter molding a dielectric covering over the contact-carrying portion, the terminals and stripped conductors, and along end lengths of the cables. During overmolding, rear ends of passageways 32 are closed off by core pins in the mold which also hold terminals 14,16 firmly against the respective top or bottom surface of contact-carrying portion 36 of housing 12.

Each signal terminal 14 preferably includes a single conductor-receiving slot 40 which is of a width just less than the diameter of a corresponding signal conductor 18. Signal conductor 18 is then wiped carefully along and into slot 40 by appropriate apparatus such as that disclosed in U.S. Pat. No. 4,649,636 assigned to the assignee hereof. Signal conductor 18 will be held by interference fit within slot 40 until being welded therein such as preferably by laser welding.

Figure 3:
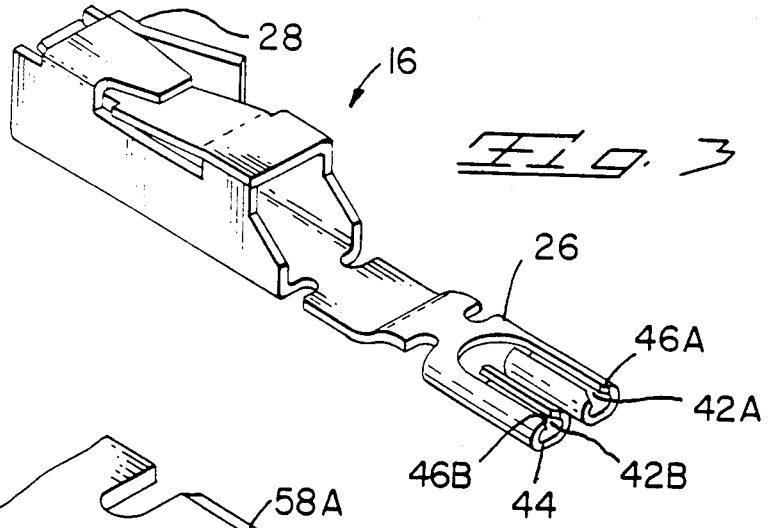
FIG. 3 is an enlarged view of the embodiment of the dual slot terminal of FIG. 2.

Each ground terminal 16, best seen in FIG. 3, includes a spaced pair of parallel conductor-receiving slots 42A,42B extending forwardly from a rearward end 44 of terminal 16. Within each slot 42A,42B will be wiped a respective ground conductor 24A,24B as with signal conductor 18 in slot 40 of signal terminal 14 above. Best seen in FIGS. 5A,5B and 6, slots 42A,42B are slightly less wide than the diameter of respective ground conductors 24A,24B, to hold them in interference fit therein until being welded therein such as preferably by laser welding. Slots 42A,42B preferably have lead-ins 46A,46B respectively to assist in receiving a respective conductor being wiped thereinto and minimize possible damage to the conductor wire which may typically have a diameter of about 0.010 inches.

Figure 4A:
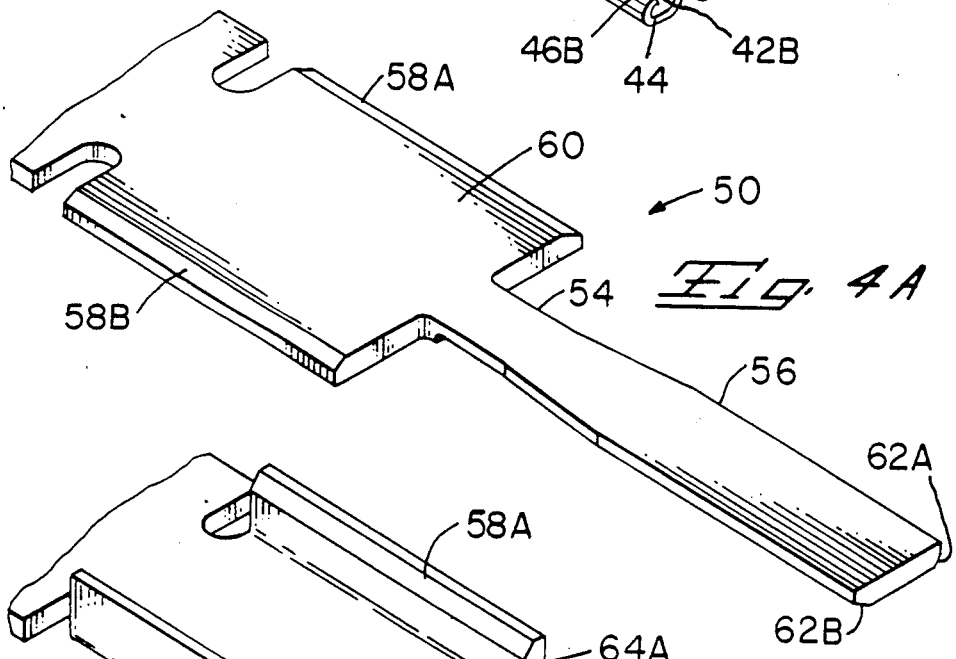
Figure 4B:
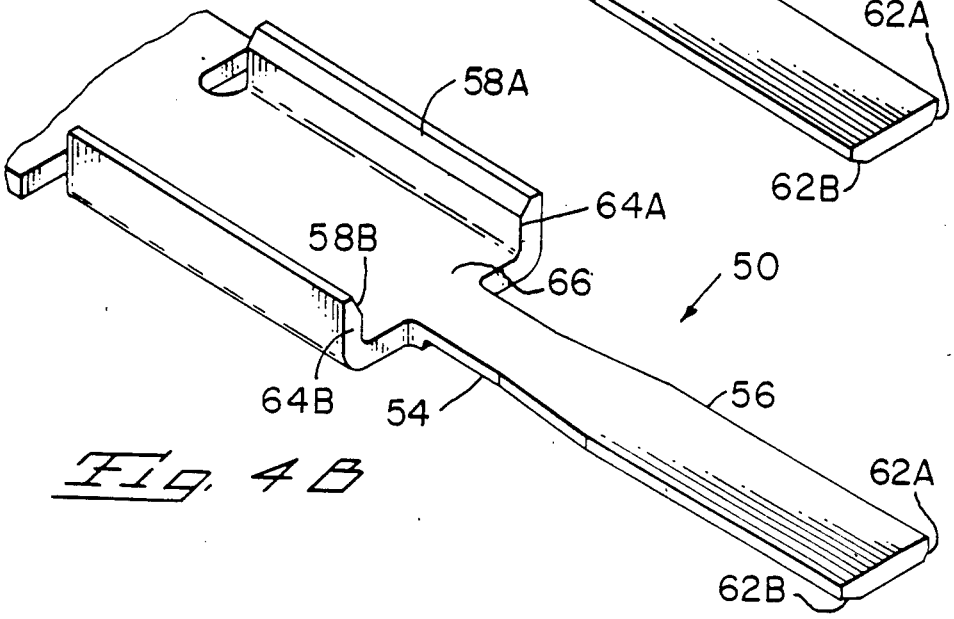

A dual slot ground terminal of the present invention may be of the type having a termination section shown in FIGS. 4A to 4C. Such a dual slot terminal is disclosed in U.S. patent application Ser. No. 882,126 filed July 3, 1986 (concurrently herewith). Terminal 50 is stamped from a sheet of metal such as phosphor-bronze alloy, Copper Alloy 511 having a thickness of for example 0.008 inches. Forward contact section 52 may be of the receptacle type shown in FIG. 3. Prior to forming it is preferred to swage top side edges 58A,58B of termination section 60 and bottom side edges 62A,62B of tab portion 56. In FIG. 4B side portions of termination section 60 are bent upward to form side walls 64A,64B, and in FIG. 4C tab portion 56 is bent up and then back along surface 66 of termination section 60, forming two slots 68A,68B in termination section 60. Swaged edges 58A,58B and 62A,62B are disposed along slots 68A,68B and will cooperate to form axially extending lead-ins to receive respective conductors being wiped thereinto, while neck portion 54 being narrower than tab portion 56 and also tapered now defines initial lead-ins 70 at the cable-proximate end of termination section 60. In FIGS. 5A and 5B stripped conductors 72A,72B are shown first partially wiped into interference fit within respective slots 68A,68B, and then fully wiped thereinto. Conductor 72A is terminated by weld joint 74A which is preferably a laser weld joint. FIG. 6 illustrates conductors 72A,72B in interference fit between sides of tab portion 56 and respective opposing sidewalls 64A,64B and showing weld joint 74A of conductor 72A to terminal 50.

Figure 7A:
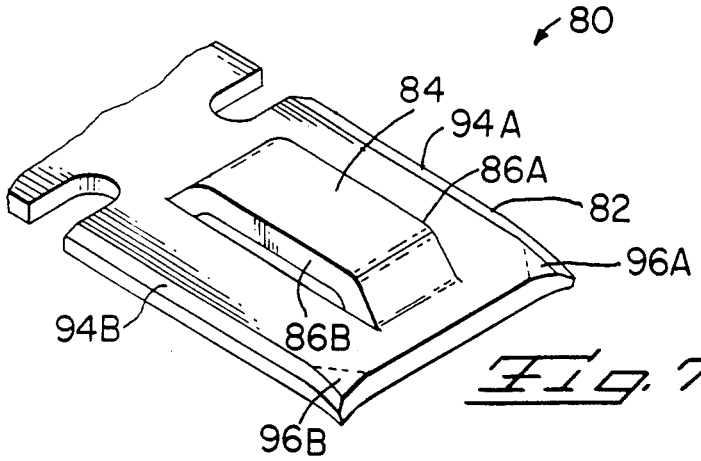
FIGS. 7A, 7B and 8 are perspective views of alternate embodiments of the present invention.
Figure 7B:
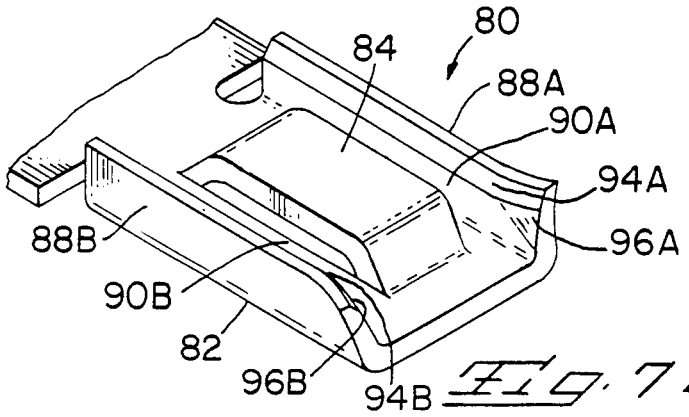

FIGS. 7A and 7B illustrate another embodiment of the dual slot terminal of the present invention. Terminal 80 is of the type disclosed in U.S. patent application Ser. No. 882,047 filed July 3, 1986 (concurrently herewith). Termination section 82 has a central boss 84 stamped upwardly therefrom which extends axially and has precise vertical side surfaces 86A,86B. Sidewalls 88A,88B are formed bent upwardly opposed from side surfaces 86A,86B to define slots 90A,90B. Sidewalls 88A,88B may be higher than the top surface of central boss 84 and may have rounded bosses extending inwardly towards central boss 84 centered slightly above its top surface to provide the necessary narrow slot width at one axial location to hold conductor wires in interference fit in slots 90A,90B. Swaging of edges 94A,94B as in terminal 50 of FIG. 5C, and either swaging or bending or both of corners 96A,96B is preferred. Terminal 80 of FIG. 7B is believed to be easier to manufacture, with good control of slot width.

Figure 8:
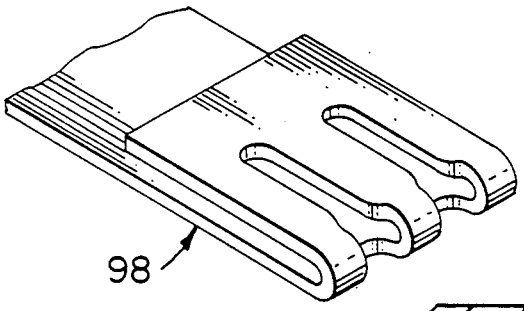

FIG. 8 illustrates still another embodiment of a dual slot terminal of the present invention, terminal 98.

The dual slot terminal of the present invention can be made in several specific ways with minor variations in the ultimate structure, without departing from the spirit of the invention and the scope of the claims. Such a terminal would most commonly be used as a ground terminal for a tri-lead cable to receive a pair of ground wires associated with the same signal conductor. But the terminal can be used to receive ground conductors from two cables, or even signal conductors from two different cables were it be desired for the terminal to conduct an electrical signal from either one of a pair of cables.

What is claimed is:

1. In a ground terminal for terminating an associated pair of small diameter ground conductor wires of tri-lead electrical cable means without substantially distorting the wires, for a multi-terminal electrical connector for a plurality of signal and associated ground conductor wires to be applied to electrical cable means for use in transmitting electrical signals with high reliability and uniformity, where the ground terminal includes a forward contact section and a terminating section axially rearwardly therefrom, the improvement comprising said terminating section including a spaced pair of discrete conductor-receiving slots coextending forwardly substantially in parallel from a rearward end thereof, the spacing of centers of said slots being about equal to the spacing of said associated ground conductor wires in said tri-lead electrical cable means, whereby said wires are terminable to said ground terminal substantially axially forwardly of the portions thereof within the cable means insulation, and each said slot having a width at at least one axial location selected to be just less than a respective said conductor wire and defined by inside surface portions of opposing side walls to hold a said conductor wire in interference fit therein at said at least one axial location to be terminated by laser welding, whereby each said ground conductor wire is weldable to said ground terminal by a discrete laser weld joint needing to be only slightly wider than a corresponding said slot thereby requiring less energy to perform the laser welding and reducing the risk of damaging each said wire.

2. An improved ground terminal as set forth in claim 1 wherein said slots each have a depth approximately equal to the diameter of a said ground conductor wire, so that top portions of said ground conductor wire are approximately coplanar with adjacent top surface portions of said termination section on at least one side of said slot, for laser weld termination.

3. An improved ground terminal as set forth in claim 1 wherein the edges at the tops of said slots are swaged to define lead-ins for wiping thereinto respective said ground conductor wires.

* * * * *